US006775861B1

(12) United States Patent
Devereaux et al.

(10) Patent No.: US 6,775,861 B1
(45) Date of Patent: Aug. 17, 2004

(54) TRANSPORTABLE HYDROTHERAPY EQUIPMENT FOR A CHILD

(76) Inventors: Thomas Devereaux, 1717 Fincher Rd., Canton, GA (US) 30114; Sherry Devereaux, 1717 Fincher Rd., Canton, GA (US) 30114

( * ) Notice: Subject to any disclaimer, the term of this patent is extended or adjusted under 35 U.S.C. 154(b) by 0 days.

(21) Appl. No.: 10/374,229

(22) Filed: Feb. 25, 2003

(51) Int. Cl.[7] ..... A47K 3/02
(52) U.S. Cl. ..... 4/538; 4/541.1; D23/277
(58) Field of Search ..... 4/538, 541.1; D23/277

(56) References Cited

U.S. PATENT DOCUMENTS 3,248,741 A * 5/1966 Stout et al. ..... 4/567
D247,577 S * 3/1978 Di Giacomo ..... D24/204
6,327,721 B1 12/2001 Devereaux ..... 4/541.3
6,611,969 B2 * 9/2003 Collins et al. ..... 4/541.1

* cited by examiner

*Primary Examiner*—Charles E. Phillips

(74) *Attorney, Agent, or Firm*—John L. James

(57) ABSTRACT

A hydrotherapy unit has a housing supporting a tub. The tub has an exterior sidewall configured to resemble an object of amusement for a child such as a duck or an automobile. When configured as an automobile, a steering wheel is attached to the exterior sidewall with mounting arms and thumbscrews. A bracket extends downwardly from the arms and forms an accelerator pedal.

6 Claims, 2 Drawing Sheets

TRANSPORTABLE HYDROTHERAPY EQUIPMENT FOR A CHILD

FIELD OF THE INVENTION

The present invention relates generally to hydrotherapy equipment, and, more particularly, to a whirlpool bath for children for circulating liquid to bathe a child and to treat body disorders and injuries.

BACKGROUND OF THE INVENTION

Hydrotherapy is used to treat a number of conditions that afflict the human body as well as for a relaxing massage. When the body is partially submerged in a tub of water, a stream of water, air, or mixture of air and water impinging on submerged portions of the body improves blood circulation providing more oxygen for healing. Zone therapy reflex areas exist on the body, that, when stimulated, increase blood flow to congested areas of the body. Circulating fluid in a hydrotherapy unit of conventional whirlpool bath provides stimulation. Hydrotherapy units are not typically found in homes or apartments where people reside, and it is usually inconvenient to visit a commercial location. Home whirlpool baths are relatively expensive and are not standard equipment, particularly in apartments and older homes. Accordingly, it will be appreciated that it would be highly desirable to have a hydrotherapy unit that is relatively inexpensive and does not require a plumber to install. It is also desirable to have a hydrotherapy unit that is transportable so that apartment dwellers can use it where space is limited and can take it with them when they move.

Using a hydrotherapy unit requires patience which is often lacking in children because children are energetic and restless. It is therefore desirable to have a hydrotherapy unit that is fun for a child to use and that does not contribute to restlessness.

SUMMARY OF THE INVENTION

The present invention is directed to overcoming one or more of the problems set forth above. Briefly summarized, according to one aspect of the present invention, a hydrotherapy unit for a child comprises a housing and an elongated open tub mounted on the housing for holding a volume of fluid. The tub has a pair of upstanding interior sidewalls and interior end walls. Each interior sidewall has upper and lower portions horizontally offset from one another forming an arm rest. One end wall defines a foot rest area. The other end wall forms a back rest. The bottom of the tub has first and second portions vertically offset from one another with a connecting bridging member forming a seat. Jets are located strategically about the tub to circulate fluid about particular portions of the body of a child seated in the tub. The unit is mounted on wheels for transportability. An electrical power cord connects the unit to a power source to power the pumps and jets, while hoses provide water for filling and draining the tub.

The unit has an exterior sidewall that is configured to resemble an object of amusement for a child. For infants, the exterior sidewall is configured as a duck which an infant recognizes as a pet to be enjoyed. For larger children, the exterior sidewall is configured as an automobile. The automobile motif has a steering wheel and accelerator pedal so that a child can simulate driving while using the tub to thereby make using the tub fun.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
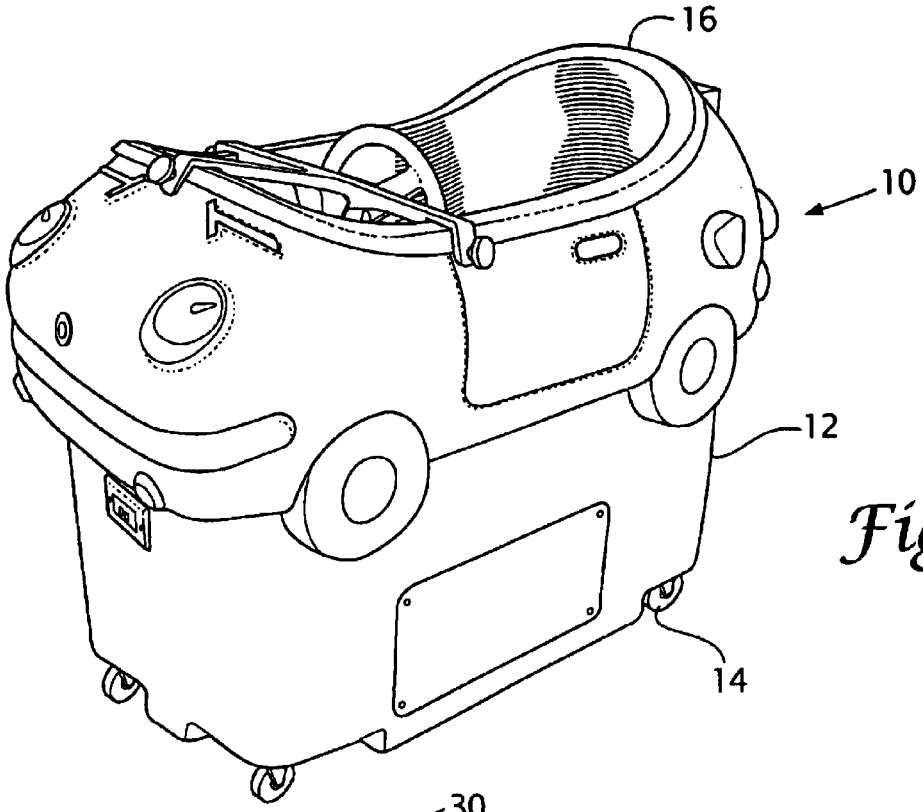
FIG. 1 is a side perspective view of a preferred embodiment of a hydrotherapy unit for a child having a seat formed in the tub and a steering wheel according to the present invention.
Figure 2:
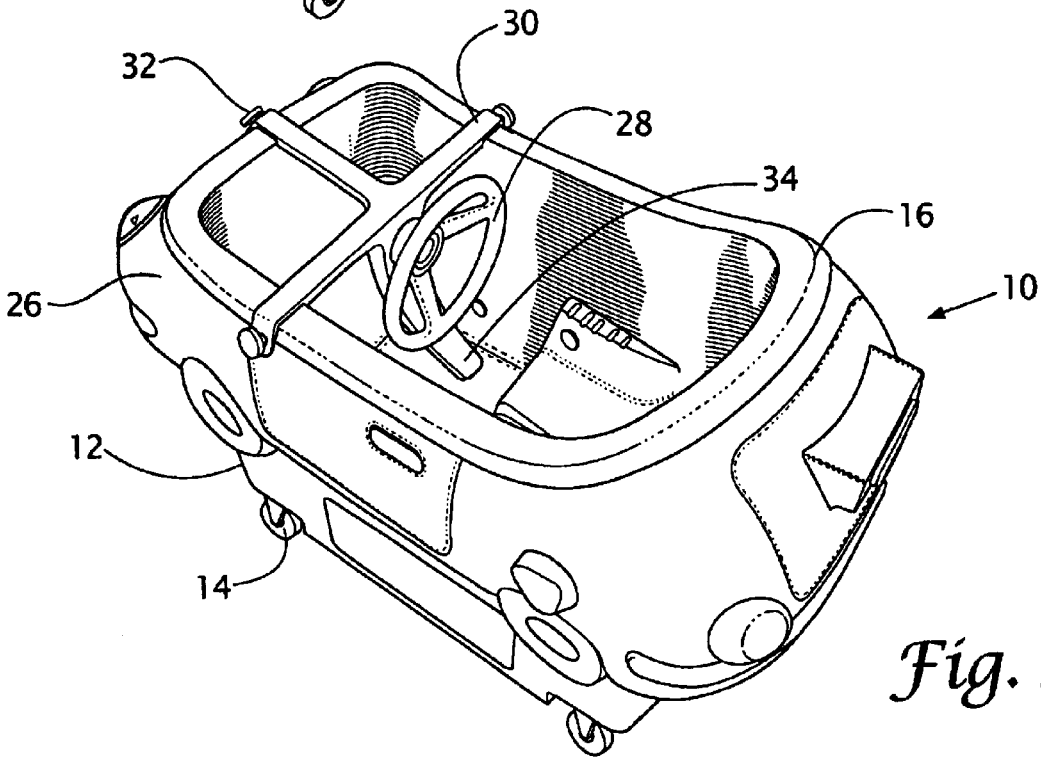
FIG. 2 is a top perspective view of the hydrotherapy unit of FIG. 1.

Referring to FIGS. 1–2, a transportable hydrotherapy unit 10 has a housing 12 that is mounted on wheels 14 so that the hydrotherapy unit 10 can be rolled about. Wheels 14 are mounted inside housing 12 to provide an aesthetic appearance and to facilitate moving the hydrotherapy unit through a doorway or from one room to another. Wheels 14 are preferably pressure locking to keep the unit stationary during use. Such wheels are spring loaded and factory set to lock at a predetermined load. For increased aesthetic appeal only a small portion of each wheel is visible below the bottom of the housing, but is sufficient for maneuverability on carpeted floors. Alternatively, a plurality of ribs or skids can be used.

The hydrotherapy unit 10 includes an elongated open tub 16 mounted on housing 12 for holding a volume of fluid, such as water or water containing therapeutic and relaxation substances. Housing 12 and tub 16 are preferably constructed of a reinforced resinous material such as the fiberglass reinforced plastic materials commonly used for bathtubs and showers, or a thermoset plastic material. The contours of the tub are void of sharp corners to be aesthetically pleasing, to facilitate fluid flow and to be more comfortable. Housing 12 and tub 16 may be separately molded or fabricated and assembled together. When assembled, the housing forms the exterior sidewalls of the unit while the tub forms the inner sidewalls of the unit with space between the exterior sidewalls and inner sidewalls to accommodate tubing, wiring and equipment needed for the unit. Such a hydrotherapy unit is more fully described in U.S. Pat. No. 6,327,721, the disclosure of which is incorporated herein by reference.

Elongated tub 16 has a pair of upstanding interior sidewalls and a pair of upstanding interior end walls. The first interior sidewall of the pair of interior sidewalls is on the right side of the tub and has upper and lower portions that are horizontally offset from one another forming a right arm rest. Similarly, the second interior sidewall of the pair of interior sidewalls is on the left side of the tub and has upper and lower portions that are horizontally offset from one another forming a left arm rest.

The first interior end wall is at the foot of the tub and defines a foot rest area. The second interior end wall is located at the head of the tub and defines a back rest area. The bottom of the tub has first and second portions vertically offset from one another with a bridging member connecting the first and second portions forming a seat. The first portion of the tub bottom is connected to the lower portion of one interior end wall at the foot of the tub, and the second portion of the tub bottom is connected to the lower portion of the other interior end wall at the head of the tub. This construction forms a seat.

The unit may be used for regular bathing or for therapeutic massage or for cleaning the body, such as when there is dead skin or debris to be removed for example. The various functions of the unit are accomplished by using a number of jets which may circulate air or liquid to cause the fluid in the tub to impact the body of the user, particularly at specific zone therapy regions of the body. Openings for the jets are provided in the tub. A jet is located in the right sidewall below the right arm rest above the seat to circulate fluid to the upper right torso of a person seated in the tub. Similarly, a jet is located in the left sidewall below the left arm rest above the seat to circulate fluid to the upper left torso of a person seated in the tub. Jet exists in the end walls to circulate fluid about the feet and ankles of a child seated in the tub. Another jet exists in the second end wall to circulate fluid about the back of a child. Additional jets in the sidewalls target the legs and thighs.

Still referring to FIGS. 1–2, the exterior sidewall 26 of the tub is configured as an item of amusement for a child. By item of amusement for a child it is meant an item, object animal or thing that captures a child's attention, causes a child to smile, peaks a child's imagination or curiosity, or the child views it as a toy or plaything. As illustrated, the exterior sidewall 26 of the tub is configured as a machine or vehicle, in this case, an automobile. The automobile motif includes a steering wheel 28 supported by mounting arms 30 removably attached to the exterior sidewall 26 with thumbscrews 32 or the like. There are preferably three arms 30 each attached with a thumbscrew 32. Alternatively, the mounting arms could be attached to the interior sidewalls and front end wall. A bracket extends downwardly from the junction of the three arms forming a simulated accelerator pedal 34. Steering wheel 28 is preferably mounted at the junction of the arms or on the bracket 28.

Figure 3:
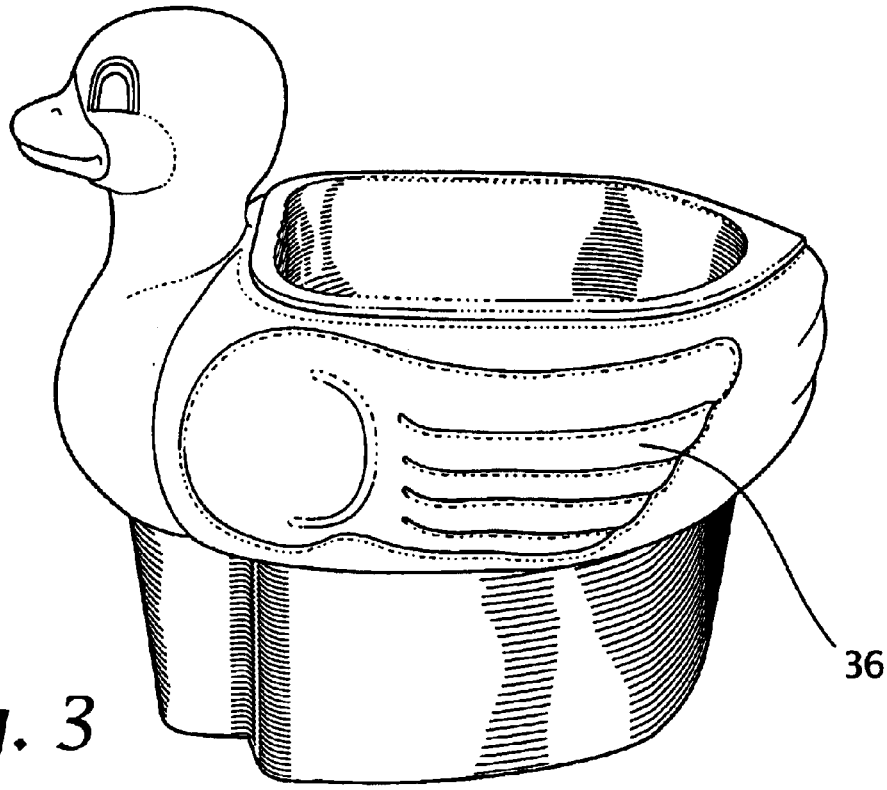
FIG. 3 is a side perspective view of another preferred embodiment of a hydrotherapy unit according to the present invention.
Figure 4:
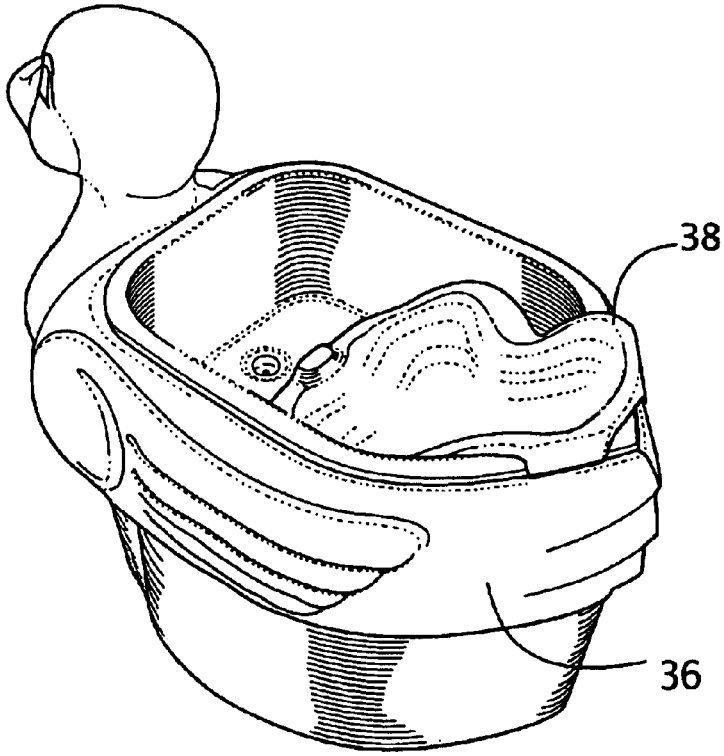
FIG. 4 is a top perspective view of the hydrotherapy unit of FIG. 3.

Referring to FIGS. 3–4, an exterior sidewall of the tub is configured as a fowl, such as a duck 36 for example. To accommodate smaller children, an insert 3 for the tub functions as a booster seat. It is anticipated that a child will migrate from the duck to the car as the child grow or ages—everybody loves to drive an automobile, even a toy automobile.

Operation of the hydrotherapy unit is believed to be apparent from the foregoing description and drawings, but a few words will be added for emphasis. The unit is rolled on its wheels or slid on its skids to the desired location and the tub filled with water by attaching a fill hose to a water faucet to fill to the desired level. Filling the tub will cause wheels to lock when water in the tub reaches a predetermined level to immobilize the unit. The drain hose is preferably attached prior to filling or during filling and routed to a suitable household drain. An invalid can be lowered onto the seat prior to attaching the power cord. A person not needing assistance will attach the power cord prior to entering the tub. Additives to the water cam be introduced as the tub fills or at any time according to instructions for the additive. The jets for circulating the fluid are turned on by pressing the air switch near the right hand of the user. Fluid turbulence is controlled by adjusting the air intake. During use, if the fluid rises above the predetermined threshold level, the drain pump automatically operates to pump out excess fluid. When finished with the bath or therapy, the discharge pump switch is operated to drain the tub. The power cord and hoses are coiled about the bracket until the next use. The wheels or skids are used to move the unit to its storage area until needed.

It can now be appreciated that a transportable hydrotherapy unit has been presented that features a motif to hold a child's attention. It can be used in hospitals, nursing facilities, schools and other institutions, and homes as well. The unit features a nonskid seat, built-in ground fault protection, air switches and an automatic over flow. Its wheels or skids allow for easy movement from a storage location to a work location. Because the unit is constructed of waterproof material with the working components protected from the elements, it can be used outdoors as well as indoors.

While the invention has been described with particular reference to the preferred embodiments, it will be understood by those skilled in the art that various changes may be made and equivalents may be substituted for elements of the preferred embodiment without departing from invention. For example, the exterior sidewall can be formed in any configuration to hold a child's attention.

As is evident from the foregoing description, certain aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

What is claimed is:

1. A hydrotherapy apparatus, comprising:

a housing;

an elongated open tub mounted on said housing for holding a volume of fluid, said tub having a pair of upstanding interior sidewalls, a pair of upstanding interior end walls and an exterior sidewall configured as a vehicle;

a first sidewall of said pair of interior sidewalls defining a first arm rest;

a second sidewall of said pair of interior sidewalls defining a second arm rest;

a first end wall of said pair of interior end walls defining a foot rest area;

a second end wall of said pair of interior end walls defining a back rest;

a bottom of said tub having first and second portions vertically offset from one another with a bridging member connecting said first and second portions forming a seat, said first portion being connected to said lower portion of said first end wall, said second portion being connected to said lower portion of said second end wall; and a steering wheel supported by mounting arms removably attached to said exterior sidewall.

2. A hydrotherapy apparatus, as set forth in claim 1, including an insert for said tub.

3. A hydrotherapy apparatus, as set forth in claim 2, wherein said insert is a booster seat.

4. A hydrotherapy apparatus, as set forth in claim 1, wherein said vehicle is an automobile.

5. A hydrotherapy apparatus, as set forth in claim 1, wherein said mounting arms are removably attached with thumbscrews.

6. A hydrotherapy apparatus, as set forth in claim 1, including a bracket extending downwardly from said steering wheel forming a simulated accelerator pedal.

* * * * *